US011013066B2

(12) United States Patent
Takeuchi

(10) Patent No.: US 11,013,066 B2
(45) Date of Patent: May 18, 2021

(54) HEATER

(71) Applicant: KYOCERA Corporation, Kyoto (JP)

(72) Inventor: Yuta Takeuchi, Kirishima (JP)

(73) Assignee: KYOCERA CORPORATION, Kyoto (JP)

( * ) Notice: Subject to any disclaimer, the term of this patent is extended or adjusted under 35 U.S.C. 154(b) by 262 days.

(21) Appl. No.: 16/066,338

(22) PCT Filed: Dec. 26, 2016

(86) PCT No.: PCT/JP2016/088645
§ 371 (c)(1),
(2) Date: Jun. 27, 2018

(87) PCT Pub. No.: WO2017/130619
PCT Pub. Date: Aug. 3, 2017

(65) Prior Publication Data

US 2019/0001787 A1 Jan. 3, 2019

(30) Foreign Application Priority Data

Jan. 27, 2016 (JP) ..... JP2016-013425

(51) Int. Cl.
*H05B 3/08* (2006.01)
*H05B 3/06* (2006.01)
(Continued)

(52) U.S. Cl.
CPC ..... *H05B 3/06* (2013.01); *H05B 3/10* (2013.01); *H05B 3/18* (2013.01); *H05B 3/48* (2013.01); *H05B 2203/027* (2013.01)

(58) Field of Classification Search
CPC ... H05B 3/06; H05B 3/10; H05B 3/18; H05B 3/48; H05B 3/08; H05B 3/26; H05B 3/262; H05B 3/28; H05B 3/283; H05B 3/32; H05B 3/0042; H05B 2203/027; H05B 1/0239; H05B 1/0291; F23Q 7/00;
(Continued)

(56) References Cited

U.S. PATENT DOCUMENTS

2013/0160730 A1* 6/2013 Kan ..... H05B 3/141 123/145 A
2016/0061447 A1* 3/2016 Kobayashi ..... F23Q 7/22 219/270

FOREIGN PATENT DOCUMENTS

DE 10023395 A1 12/2000
DE 102011077659 A1 4/2012
(Continued)

*Primary Examiner* — Shawntina T Fuqua
(74) *Attorney, Agent, or Firm* — Volpe Koenig

(57) ABSTRACT

A heater of the present disclosure includes: a columnar heater main body including a ceramic body, and a heat generating resistor embedded within the ceramic body, the heat generating resistor being drawn out at a rear end portion of the ceramic body to a side surface of the heater main body; a tubular metal support member attached to the side surface of the heater main body, the metal support member including a first region joined via a bonding material to the heater main body and a second region spaced away from the heater main body, the metal support member being configured so as to open toward the rear end portion; and a lid body which is disposed between the heater main body and the second region to separate front end-side space and rear end-side space of the heater.

7 Claims, 3 Drawing Sheets

(51) Int. Cl.
*H05B 3/48* (2006.01)
*H05B 3/10* (2006.01)
*H05B 3/18* (2006.01)

(58) Field of Classification Search
CPC . F23Q 7/001; F23Q 3/00; H01T 13/00; H01T 13/02; H01T 13/04; H01T 13/08; H01T 13/20; H01T 13/22
See application file for complete search history.

(56) References Cited

FOREIGN PATENT DOCUMENTS

| | | | |
|---|---|---|---|
| JP | 2001-280640 | A | 10/2001 |
| JP | 2002-134251 | A | 5/2002 |
| JP | 2012-009338 | A | 1/2012 |

* cited by examiner

HEATER

TECHNICAL FIELD

The present disclosure relates to a heater for use in, for example, a vehicle-mounted heating system, etc.

BACKGROUND ART

There is a heretofore known heater comprising a columnar heater main body having a ceramic body, and a heat generating resistor embedded within the ceramic body, the heat generating resistor being drawn out at a rear end portion of the ceramic body to a side surface of the heater main body; and a tubular metal support member attached to the side surface of the heater main body (refer to Patent Literatures 1 and 2).

In cold climates, for example, in Northern European countries, a vehicle-mounted heating system incorporating a heater under idling control is used. Thus, there emerged a need to raise the temperature of a heater for ignition rapidly even in a very cold environment with temperatures below-freezing, and also, in keeping with the tightening of environmental regulations, further speedup in temperature rise has been sought after.

CITATION LIST

Patent Literature

Patent Literature 1: Japanese Unexamined Patent Publication JP-A 2001-280640

Patent Literature 2: Japanese Unexamined Patent Publication JP-A 2002-134251

SUMMARY OF INVENTION

Solution to Problem

A heater according to the present disclosure comprises: a heater main body having a columnar shape, comprising a ceramic body, and a heat generating resistor embedded within the ceramic body, the heat generating resistor being drawn out at a rear end portion of the ceramic body to a side surface of the heater main body; a metal support member having a tubular shape and attached to the side surface of the heater main body, the metal support member comprising a first region joined via a bonding material to the heater main body and a second region spaced away from the heater main body, the metal support member being configured so as to open toward a rear end portion; and a lid body which is disposed between the heater main body and the second region to separate front end-side space and rear end-side space of the heater.

DESCRIPTION OF EMBODIMENTS

The following describes one embodiment of the heater of the invention with reference to the drawings.

Figure 1:
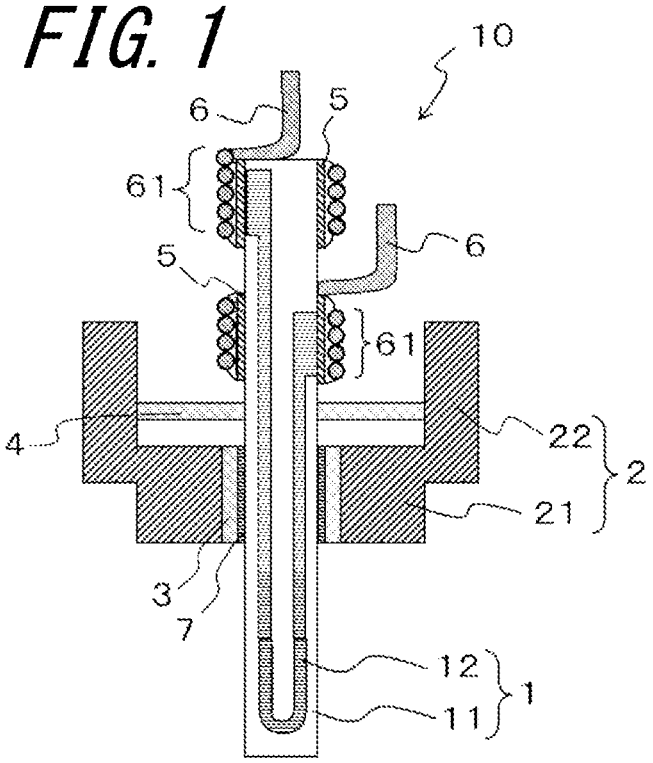
FIG. 1 is a schematic longitudinal sectional view showing one embodiment of the heater.

FIG. 1 is a schematic longitudinal sectional view showing one embodiment of the heater. As shown in FIG. 1, a heater 10 according to the embodiment comprises: a columnar heater main body 1 having a ceramic body 11 and a heat generating resistor 12 embedded within the ceramic body 11, the heat generating resistor 12 being drawn out at a rear end portion of the ceramic body 11 to a side surface of the heater main body 1; and a tubular metal support member 2 attached to the side surface of the heater main body 1, the metal support member 2 comprising a first region 21 joined via a bonding material 3 to the heater main body 1 and a second region 22 spaced away from the heater main body 1, the metal support member 2 being configured so as to open toward the rear end portion; and a lid body 4 which is disposed between the heater main body 1 and the second region 22 to separate front end-side space and rear end-side space of the heater 10.

For example, the heater main body 1 has a columnar shape such as a circular cylinder or a prism. For example, the heater main body 1 has a length of 20 mm to 60 mm, and has, when made to have a circular sectional profile, a diameter of 2.5 mm to 5.5 mm.

Exemplary of the material used for the ceramic body 11 constituting the heater main body 1 is electrically insulating ceramics such as oxide ceramics, nitride ceramics, or carbide ceramics. More specifically, it is possible to use alumina ceramics, silicon nitride ceramics, aluminum nitride ceramics, and silicon carbide ceramics. Among them, silicon nitride ceramics is suitable for use because of containing, as a major constituent, silicon nitride which is superior in points of strength, toughness, insulation capability, and resistance to heat.

A compound of a metal element contained in the heat generating resistor 12 may be included in the ceramic body 11. For example, where the heat generating resistor 12 contains tungsten or molybdenum, $WSi_2$ or $MoSi_2$ may be included in the ceramic body 11. This makes it possible to render the silicon nitride ceramics used as a matrix analogous in thermal expansion coefficient to the heat generating resistor 12, and thereby enhance the durability of the heater.

The heat generating resistor 12 is embedded within the ceramic body 11. As the material for forming the heat generating resistor 12, a heat-resistant material, for example, tungsten or tungsten carbide is used. In the embodiment shown in FIG. 1, when viewed in a longitudinal section of the columnar heater main body 1 (a section parallel to the length direction of the columnar heater main body 1), the heat generating resistor 12 has a folded-back portion to define a folded-back pattern at a front end thereof, and a part of the folded-back portion near the center thereof (near an intermediate point on the folded-back portion) serves as a heat generating section which liberates heat to the greatest extent. In addition, the heat generating resistor 12 includes a pair of linear portions, each extending from the folded-back portion toward the rear end portion, and, a part of each linear portion located on the rear end side is drawn out at the rear end portion of the ceramic body 11 to the side surface, and the heat generating resistor 12 is electrically connected via a conductive bonding material to a lead member 6 which will hereafter be described. The heat generating resistor 12 may be given any one of a circular transverse-sectional profile, an elliptical transverse-sectional profile, and a rectangular transverse-sectional profile.

Moreover, while the front end-side folded-back portion and the pair of rear end-side linear portions are formed of the same material in the heat generating resistor 12, for the purpose of reducing unnecessary heat generation, for example, the linear portion may be made lower in resistance per unit length than the folded-back portion by adjusting the cross-sectional area of the linear portion to be larger than that of the folded-back portion, or by reducing the amount of the ceramic body 11 constituting material contained in the linear portion. Note that the heat generating resistor 12 does not necessarily have to be composed of the folded-back portion and the pair of linear portions in the pattern as shown in FIG. 1, and thus, for example, the heat generating resistor 12 may be folded back plural times to form a repeatedly folded-back pattern, or may be constructed by stacking the patterns shown in FIG. 1 in two layers.

On the surface (side surface) of the ceramic body 11, on an as needed basis, there is provided an electrode layer 5 electrically connected to the heat generating resistor 12 embedded within the ceramic body 11. For example, the electrode layer 5 is formed of molybdenum (Mo) or tungsten (W), and has a thickness of 50 μm to 300 μm, for example. The electrode layer 5 may either be disposed only on a part of the surface of the ceramic body 11 where the heat generating resistor 12 is drawn out and a nearby area, or be disposed over the entire circumference of the ceramic body 11 so as to face a coil portion 61 which constitutes a lead member 6 as will hereafter be described. In the embodiment shown in FIG. 1, there are two areas in which the heat generating resistor 12 is drawn out, and, the electrode layer 5 is disposed over the entire circumference at each of the two areas. Since the two areas in which the heat generating resistor 12 is drawn out are located in different positions in a longitudinal direction, the electrode layer 5 at one of the two areas and the electrode layer 5 at the other of the two areas can be disposed so as not to be electrically connected to each other. Moreover, the electrode layer 5 may have a surface thereof plated with a Ni—B layer or a Au layer, for example.

There is provided a lead member 6 comprising a coil portion 61 composed of a plurality of turns of metallic wire wound about the ceramic body 11 so as to cover the electrode layer 5. For example, the lead member 6, which is formed of a Ni—Fe—Ni heat-resistant alloy, etc., is 0.5 to 2.0 mm in diameter. In the embodiment shown in FIG. 1, two lead members 6 are provided. Each lead member 6 comprises the coil portion 61 composed of a plurality of turns of metallic wire, and more specifically the coil portion 61 typically is composed of 2 to 6 turns of metallic wire. The electrode layer 5 and the coil portion 61 of the lead member 6 are electrically connected to each other via a brazing material formed of Ag, Cu, Au, etc.

Moreover, to the side surface of the heater main body 1, there is attached the tubular metal support member 2 which serves as a support member for external securement when using the heater as a glow plug, for example. The metal support member 2 is formed of, for example, an alloy of Fe, Ni, etc., or more specifically stainless steel (SUS), a Fe—Ni—Co alloy, or a Ni-based heat-resistant alloy.

The metal support member 2 comprises the first region 21 joined via the bonding material 3 to the heater main body 1 and the second region 22 spaced away from the heater main body 1. Moreover, the metal support member 2 is configured so as to open toward the rear end portion. In the embodiment shown in the drawing, the inner and outer surfaces of the metal support member 2 are stepped so that the dimension of the metal support member 2 becomes larger gradually from the first region 21 to the second region 22, and, the metal support member 2 is configured so as to open toward the rear end portion. With no specific limitation imposed upon the shape of the metal support member 2, for example, the metal support member 2 may be designed so that only the inner surface is stepped or shaped so that a diameter thereof becomes larger gradually from the front end to the rear end, or alternatively the metal support member 2 may be cylindrically shaped.

As the bonding material 3 used for bonding of the heater main body 1 (ceramic body 11) with the first region 21, it is possible to use a brazing material, solder, or glass material. In the interest of enhancement in bonding strength, a brazing material, for example, Ag—Cu brazing metal is desirable for use. In this case, when the brazing process is performed after a metallic layer 7 is formed on the surface of the heater main body 1 (ceramic body 11), the joining property of the joining portion between the heater main body 1 (ceramic body 11) and the metal support member 2 (the first region 21) is improved.

In order to cause the bonding material 3 to spread sufficiently into the first region 21 for attainment of bonding force of adequate level, for example, the inside diameter of the first region 21 is set to a range of 101% to 120%, or preferably 105% to 115%, of the outside diameter of a part of the heater main body 1 where the first region 21 is disposed (the sum total of the diameter of the ceramic body 11 and the thickness of the metallic layer 7). Moreover, the inside diameter of the second region 22 is set to 100% or more of the inside diameter of the first region 21.

The lid body 4 is disposed between the heater main body 1 and the second region 22 to separate front end-side space and rear end-side space of the heater 10. Space is left between the outer surface of the heater main body 1 and the inner surface of the second region 22 constituting the metal support member 2, and, the lid body 4 in circular plate form is placed within this space so as to be oriented perpendicularly to the longitudinal direction of the heater main body 1. The lid body 4 has, at a center thereof, a hole for insertion of the heater main body 1, and is thus fixedly fitted to the heater main body 1. The lid body 4 has a thickness of 0.5 mm to 4 mm, for example. Although not shown in the drawing, the inner wall of the second region 22 may be provided with a projection, a rib, or a shoulder for the positioning of the lid body 4.

For example, when raising the temperature of the heater rapidly in a very cold environment with temperatures below-freezing, the joining portion between the metal support member 2 and the ceramic body 11 are subjected to thermal shock, causing a crack in the joining portion. As the crack propagates over an extended period of use, a decrease in resistance may occur.

In this regard, according to the heater 10 thereby constructed, the lid body 4 partitions the space left between the heater main body 1 and the second region 22 into front end-side space (space around the joining portion) and rear end-side space (external space) of the heater 10. This makes it possible to restrain cold air from finding its way into the joining portion between the first region 21 of the metal support member 2 and the heater main body 1 (ceramic body 11). Moreover, when air present in the front end-side space (space around the joining portion) which is part of the space left between the heater main body 1 and the second region 22 warms due to heat conduction via the heater main body 1 and the metal support member 2, the lid body 4 blocks the exchange of the warmed air. This makes it possible to protect the joining portion between the heater main body 1 (ceramic body 11) and the metal support member 2 (the first region 21) from thermal shock, and thereby retard crack propagation, with the consequence that variation in resistance can be reduced for a long period of time.

While metal, ceramics, or the like may be used for the lid body 4, the lid body 4 is desirably formed of ceramics such as alumina or silicon nitride, for example. Ceramics is higher in insulation capability and yet lower in thermal conductivity than metal, and thus excels as the lid body 4. It is particularly desirable that the lid body 4 and the ceramic body 11 are predominantly composed of the same material. In this case, in contrast to a case where the ceramic body 11 is formed of silicon nitride and the lid body 4 is formed of alumina, the lid body 4 and the ceramic body 11 become substantially identical in thermal expansion coefficient.

Figure 2:
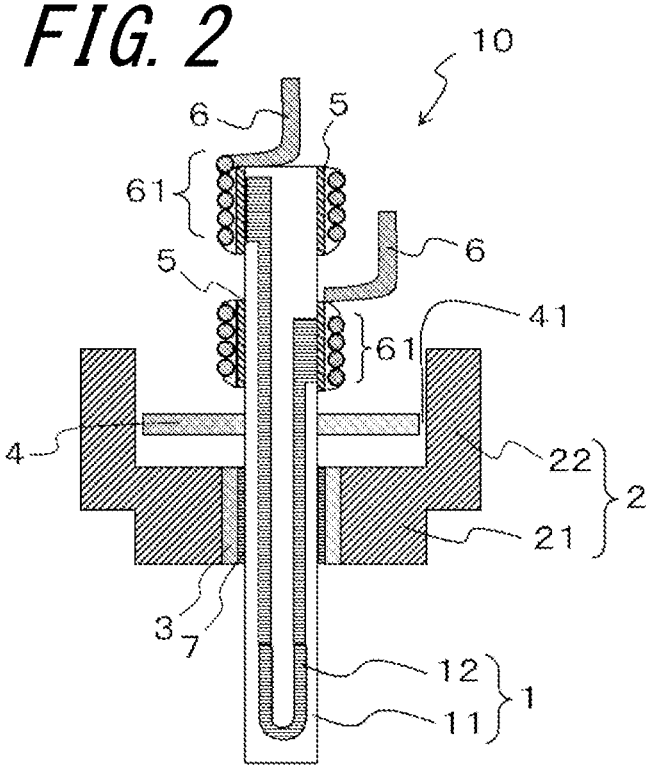
FIG. 2 is a schematic longitudinal sectional view showing another embodiment of the heater.

Moreover, as shown in FIG. 2, the lid body 4 may be disposed between the heater main body 1 and the second region 22 so as to leave a spacing 41 from at least one of the heater main body 1 and the second region 22. According to the heater 10 with such a structure, even if air present in the front end-side space between the second region 22 of the metal support member 2 and the heater main body 1 expands under heating or contracts under cooling, the pressure of the air and the pressure of external air can be maintained at a substantially uniform level. This makes it possible to avoid causing damage to the lid body 4, as well as to protect the joining portion between the first region 21 of the metal support member 2 and the heater main body 1 from thermal shock for a long period of time. The spacing 41 as mentioned herein is provided to restrain cold air from finding its way into the joining portion between the first region 21 of the metal support member 2 and the heater main body 1, and also to effect air pressure adjustment while keeping on restraining warmed air present in the front end-side space between the second region 22 of the metal support member 2 and the heater main body 1 from being exchanged for air present in the rear end-side space. For example, the spacing 41 has a width of 0.1 mm to 1.2 mm. In the embodiment shown in FIG. 2, a spacing is left between the lid body 4 and the second region 22, but it is not to be construed as limiting arrangement, and, for example, a spacing which is similar in width to that spacing may be left between the lid body 4 and the heater main body 1. In another alternative, a spacing may be left both between the lid body 4 and the second region 22 and between the lid body 4 and the heater main body 1. In this case, the sum total of the widths of the two spacings is set to a range of 0.1 mm to 1.2 mm, for example.

Figure 3:
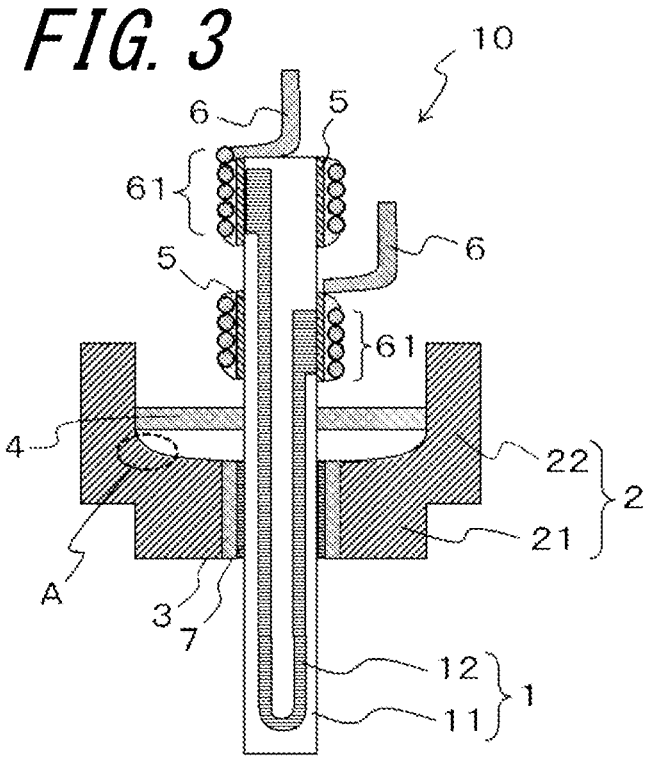
FIG. 3 is a schematic longitudinal sectional view showing still another embodiment of the heater.

Moreover, as shown in FIG. 3, in the inner wall of the metal support member 2, the front end of the second region 22 may have a radiused inner surface (refer to an area A shown in the drawing). According to the heater 10 with such a structure, even if the metal support member 2 undergoes thermal expansion and contraction repeatedly, concentration of stress will be less likely to occur between the first region 21 and the second region 22.

Figure 4:
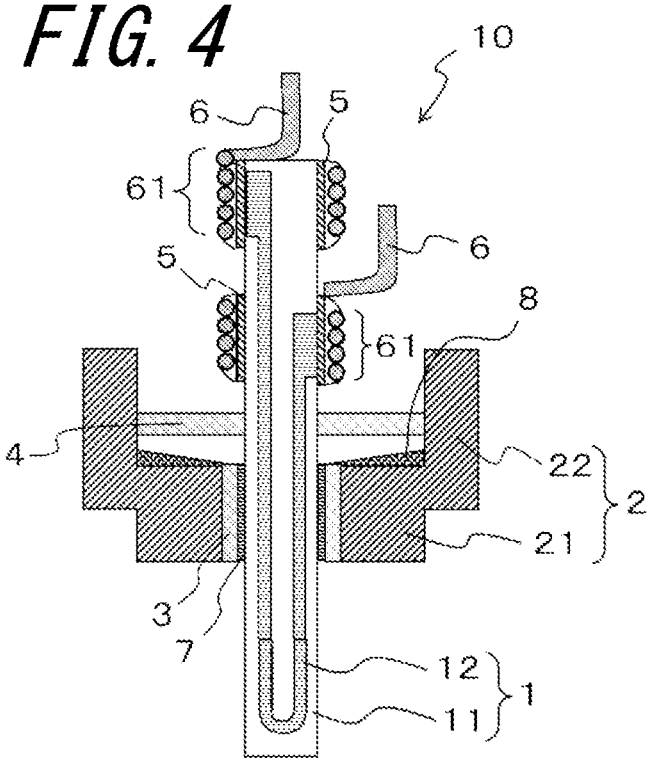
FIG. 4 is a schematic longitudinal sectional view showing still another embodiment of the heater.

Moreover, as shown in FIG. 4, in the inner wall of the metal support member 2, the corner at the boundary between the first region 21 and the second region 22 may be covered with a brazing material 8. According to the heater 10 with such a structure, the soft brazing material 8 enables dispersion or relaxation of the stress developed at the boundary between the first region 21 and the second region 22.

Figure 5:
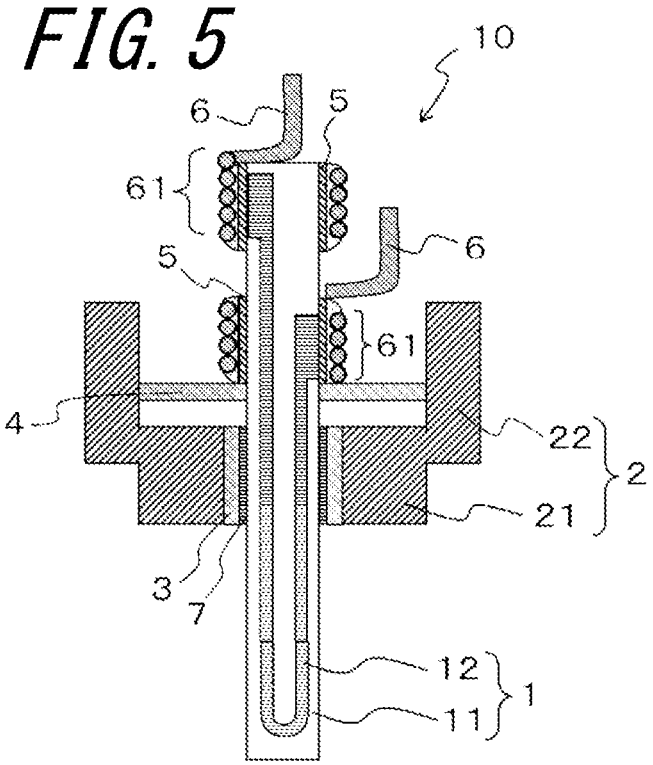
FIG. 5 is a schematic longitudinal sectional view showing still another embodiment of the heater.

Moreover, as shown in FIG. 5, the lead member 6 may be electrically connected to the heat generating resistor 12 drawn out to the side surface of the heater main body 1, and the lid body 4 may be brought into contact with the lead member 6. According to the heater 10 with such a structure, as the lid body 4 warms under Joule heating, the air present in the front end-side space between the heater main body 1 and the second region 22 warms correspondingly. This makes it possible to achieve further protection of the joining portion between the heater main body 1 (ceramic body 11) and the metal support member 2 (the first region 21) from thermal shock.

The following describes a method for manufacturing the heater according to the embodiment.

First, powdery ceramic used as a raw material for the ceramic body 11 is prepared from ceramic powder such as alumina, silicon nitride, aluminum nitride or silicon carbide containing sintering aids such as $SiO_2$, CaO, MgO or $ZrO_2$. For example, in the case where the ceramic body 11 is formed of silicon nitride ceramics, silicon nitride used as a major constituent is mixed with sintering aids, namely 3 to 12% by mass of a rare-earth element oxide such as $Y_2O_3$, $Yb_2O_3$, or $Er_2O_3$ and 0.5 to 3% by mass of $Al_2O_3$, and also with $SiO_2$ in an amount adjusted so that the amount of $SiO_2$ contained in a resultant sintered product falls within a range of 1.5% to 5% by mass.

Then, the powdery ceramic is pressed to form a ceramic compact, or is made into a ceramic slurry which is shaped like a sheet to produce a ceramic green sheet. The ceramic compact or the ceramic green sheet so obtained becomes the ceramic body 11 made in two halves.

Next, on one of the principal surfaces of the compact or the ceramic green sheet thus obtained, a conductive paste-made pattern of the heat generating-resistor 12 is formed by means of screen printing or otherwise. For example, the conductive paste may be formed of a material prepared by kneading high-melting-point metal used as a major constituent, such as W, Mo or Re, which can be co-fired with the compact which constitutes the ceramic body 11, in admixture with the above-described ceramics, a binder, an organic solvent, etc.

At this time, in conformity with the application of the ceramic heater, the length and the line width of the conductive paste-made pattern, the length and the interval of the folded-back pattern, etc. are suitably changed to set the heating position and the value of resistance in the heat generating resistor 12 as desired.

On the compact with the conductive paste-made pattern, another printed conductive paste-free compact formed of the same material is overlaid, whereupon there is obtained a molded body internally provided with the conductive paste-made pattern.

Then, the molded body thus obtained is fired at temperatures ranging from 1500° C. to 1800° C. under pressures ranging from 30 MPa to 50 MPa, for example. In this way, the heater main body 1 can be produced. It is desirable to effect firing in an atmosphere of an inert gas or in a reductive atmosphere. It is also desirable to effect firing with application of a pressure.

Next, following the working of the resultant sintered product (heater main body 1) into a rod or a plate, the rod-like or plate-like body is formed with the electrode layer 5 and the metallic layer 7 by printing using screening technique, is baked in a vacuum furnace for example, and is Ni—B plated.

Then, the metal support member 2 made of, for example, a Ni-based heat-resistant alloy is fitted, while being properly positioned, to the heater main body 1, and the lid body 4 is set in a desired position. Moreover, the lead member 6, which is obtained by cutting a metallic wire which has a diameter of 1.0 mm and is predominantly composed of Ni into a coil shape, is fitted, while being properly positioned, to the heater main body 1. After that, the metallic layer 7 and the metal support member 2 are brazed to each other, and also the electrode layer 5 and the lead member 6 are brazed to each other.

A spacing may be left between the lid body 4 and the metal support member 2 as desired by adjusting the size of the lid body 4.

Moreover, in order to form a part of the inner wall of the metal support member 2 corresponding to the front end of the second region 22 into a radiused surface, a mold adapted for the formation of such a radiused surface may be used to produce the metal support member 2.

Moreover, in order to covering the corner at the boundary between the first region 21 and the second region 22 in the inner wall of the metal support member 2 with a brazing material, the amount of the brazing material to be poured into the joining portion may be suitably adjusted.

Moreover, in order to electrically connect the lead member 6 to the heat generating resistor 12 drawn out to the side surface of the heater main body 1 and bring the lid body 4 into contact with the lead member 6, positioning of the lid body 4 and the lead member 6 may be adjusted so that a position of the lid body 4 is adjacent to a position of the lead member 6.

The method thus far described allows the heater 10 according to the embodiment to be produced.

REFERENCE SIGNS LIST

10: Heater
1: Heater main body
11: Ceramic body
12: Heat generating resistor
2: Metal support member
21: First region
22: Second region
3: Bonding material
4: Lid body
5: Electrode layer
6: Lead member
61: Coil portion
7: Metallic layer
8: Brazing material

The invention claimed is:

1. A heater, comprising:

a heater main body having a columnar shape, comprising a ceramic body, and a heat generating resistor embedded within the ceramic body, the heat generating resistor being drawn out at a rear end portion of the ceramic body to a side surface of the heater main body;

a metal support member having a tubular shape and attached to the side surface of the heater main body, the metal support member comprising a first region joined via a bonding material to the heater main body and a second region spaced away from the heater main body, the metal support member being configured so as to open toward the rear end portion; and a lid body which is disposed between the heater main body and the second region to separate front end-side space and rear end-side space of the heater, and wherein the lid body is formed of ceramics.

2. The heater according to claim 1, wherein the lid body is disposed between the heater main body and the second region so as to leave a spacing from at least one of the heater main body and the second region.

3. The heater according to claim 1, wherein a part of an inner wall of the metal support member corresponding to a front end of the second region is radiused.

4. The heater according to claim 1, wherein, in the inner wall of the metal support member, a corner at a boundary between the first region and the second region is covered with a brazing material.

5. The heater according to claim 1, further comprising:

a lead member electrically connected to the heat generating resistor drawn out to the side surface of the heater main body, wherein the lid body and the lead member make contact with each other.

6. A heater, comprising:

a heater main body having a columnar shape, comprising a ceramic body, and a heat generating resistor embedded within the ceramic body, the heat generating resistor being drawn out at a rear end portion of the ceramic body to a side surface of the heater main body;

a metal support member having a tubular shape and attached to the side surface of the heater main body, the metal support member comprising a first region joined via a bonding material to the heater main body and a second region spaced away from the heater main body, the metal support member being configured so as to open toward the rear end portion; and a lid body which is disposed between the heater main body and the second region to separate front end-side space and rear end-side space of the heater, and wherein, in the inner wall of the metal support member, a corner at a boundary between the first region and the second region is covered with a brazing material.

7. A heater, comprising:

a heater main body having a columnar shape, comprising a ceramic body, and a heat generating resistor embedded within the ceramic body, the heat generating resistor being drawn out at a rear end portion of the ceramic body to a side surface of the heater main body;

a metal support member having a tubular shape and attached to the side surface of the heater main body, the metal support member comprising a first region joined via a bonding material to the heater main body and a second region spaced away from the heater main body, the metal support member being configured so as to open toward the rear end portion;

a lid body which is disposed between the heater main body and the second region to separate front end-side space and rear end-side space of the heater; and a lead member electrically connected to the heat generating resistor drawn out to the side surface of the heater main body, and wherein the lid body and the lead member make contact with each other.

* * * * *